US009471036B2

(12) United States Patent
Kaelin et al.

(10) Patent No.: US 9,471,036 B2
(45) Date of Patent: Oct. 18, 2016

(54) TIMEPIECE BARREL

(71) Applicant: ETA SA Manufacture Horlogere Suisse, Grenchen (CH)

(72) Inventors: Laurent Kaelin, Sonvilier (CH); Arthur Queval, Lutry (CH); Martin Vautherot, Publier (FR)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 3 days.

(21) Appl. No.: 14/419,573

(22) PCT Filed: Oct. 21, 2013

(86) PCT No.: PCT/EP2013/071918
§ 371 (c)(1),
(2) Date: Feb. 4, 2015

(87) PCT Pub. No.: WO2014/095123
PCT Pub. Date: Jun. 26, 2014

(65) Prior Publication Data
US 2015/0220059 A1 Aug. 6, 2015

(30) Foreign Application Priority Data
Dec. 18, 2012 (EP) ..... 12197745

(51) Int. Cl.
*G04B 1/16* (2006.01)
*G04B 1/14* (2006.01)
*G04B 1/18* (2006.01)

(52) U.S. Cl.
CPC ..... *G04B 1/16* (2013.01); *G04B 1/145* (2013.01); *G04B 1/18* (2013.01)

(58) Field of Classification Search
CPC ..... G04B 1/14; G04B 1/145; G04B 1/16; G04B 1/165; G04B 1/18; G04B 1/185
See application file for complete search history.

(56) References Cited

U.S. PATENT DOCUMENTS

| | | | | |
|---|---|---|---|---|
| 165,831 | A | 7/1875 | Hopkins | |
| 804,728 | A | 11/1905 | Johnson et al. | |
| 996,499 | A | 6/1911 | Marshall | |
| 2010/0149928 | A1* | 6/2010 | Reynard | G04B 1/16 368/206 |
| 2014/0211595 | A1* | 7/2014 | Capt | G04B 1/145 368/142 |

FOREIGN PATENT DOCUMENTS

| | | |
|---|---|---|
| CH | 83330 | 12/1919 |
| CH | 295135 | 12/1953 |
| FR | 1 034 443 | 7/1953 |
| GB | 647 819 | 12/1950 |

OTHER PUBLICATIONS

International Search Report Issued Jan. 2, 2014 in PCT/EP13/071918 Filed Oct. 21, 2013.

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A timepiece barrel for pivotal assembly between a plate and a bar and including at least one spring housed between a pivoting drum and a cover and hooked between, at the outer end thereof, the drum and at the inner end thereof, an arbor which pivots integrally with a ratchet about a pivot axis. The barrel includes a one-piece sub-assembly coaxial to the arbor and including the arbor and a boss including a collar for limiting axial shake of the drum, the collar carrying pivotal drive mechanisms for driving pivoting of the ratchet which is axially free in a direction of the pivot axis.

9 Claims, 1 Drawing Sheet

TIMEPIECE BARREL

CROSS-REFERENCE TO RELATED APPLICATIONS

This is a national phase application in the United States of International patent application PCT/EP2013/071918 filed Oct. 21, 2013 which claims priority on European Patent application No. 12197745.8 filed Dec. 18, 2012. The entire disclosures of the above patent applications are hereby incorporated by reference.

FIELD OF THE INVENTION

The invention concerns a timepiece barrel for pivotal assembly between a plate and a bar and including at least one spring, housed between a pivoting drum and a cover and hooked between said drum at the outer end thereof and an arbor at the inner end thereof, said arbor being pivotally integral with a ratchet about a pivot axis, said barrel including a one-piece sub-assembly coaxial to said pivot axis and containing said arbor and a boss provided with a collar for limiting the axial shake of said drum, wherein said collar carries pivotal drive means for driving the pivoting of said ratchet, which is axially free in the direction of said pivot axis, and wherein the shake of said drum is limited in lower abutment relative to said one-piece sub-assembly by an upper surface of said drum which is limited by a lower shoulder of said one-piece sub-assembly, wherein the shake of said ratchet is limited in lower abutment relative to said bar, by an upper surface of said ratchet which is limited by a thread or a lower surface of said bar or of a jewel comprised in said bar, wherein the shake of said ratchet is limited in upper abutment relative to said drum by a lower surface of said ratchet which is limited by an upper surface of said drum, and wherein the shake of said cover is limited in upper abutment relative to said plate, by a lower surface of said cover which is limited by an upper surface of said plate or of a jewel comprised in said plate.

The invention also concerns a timepiece movement including at least one plate and a bar and a barrel of this type.

The invention also concerns a watch including a movement of this type.

The invention concerns the field of timepiece mechanisms, and more specifically energy storage mechanisms, of the mainspring barrel, striking barrel or similar type.

BACKGROUND OF THE INVENTION

In order to increase the power reserve, by increasing the number of turns of a mainspring, secured at the inner end thereof to a core formed either by an arbor, which is generally cylindrical, or by a more solid boss, one solution consists in decreasing the diameter of the barrel arbor and of the associated boss, so as to increase the space available for the spring inside the drum.

The ratio of the core radius to the spring thickness is usually comprised between 10 and 20 and the invention proposes to reduce this ratio to below 10, and preferably to within a range of between 5 and 10.

The sizing must be thought through carefully as there is a risk of breakage if the diameter of the core is too small.

In the conventional barrel architecture, a ratchet is axially mounted on a barrel arbor or on a core, via a square, with the ratchet usually being secured by an axial screw. The dimension of this screw and that of the square thus define the minimum diameter of a pivot shoulder. A step portion joined to this pivot shoulder limits the axial shake of the arbor or of the core relative to a plate or to a bar carrying a jewel or similar element.

In particular, it is not sufficient merely to reduce all of the dimensions, since the cross-sections of material are then insufficient to ensure fatigue resistance.

The issue is thus to reconcile the smallest possible diameter, to allow the largest possible power reserve, with rigidity in the ratchet drive.

U.S. Pat. No. 804,728A in the name of JOHNSON describes a barrel whose arbor carries a threaded hub, which in turn carries a mainspring. Two components are therefore necessary for the internal holding of the spring. The drum barrel is guided by a jewel which is not in a single piece with the arbor. The rewinding ratchet is located on the other side of the barrel bar. The portion carrying the square driving the ratchet is not formed by a collar, but by the end of the arbor which protrudes beyond the bar, on the opposite side to the drum.

CH Patent Application No 83330A in the name of BEAULIEU WATCH CO describes a barrel with no cover, including a core screwed onto an arbor. The drum is loosely fitted onto the arbor, between a shoulder of the arbor and the core. Here too, two components are required for the internal holding of the spring.

CH Patent Application No 295135 A in the name of BRAC AG describes a barrel whose plate includes a support thread for the ratchet.

SUMMARY OF THE INVENTION

The invention proposes to improve the design of known barrels devised for a large power reserve by procuring a high level of rigidity, particularly as regards the ratchet, while maintaining a reduced number of components, and acceptable machining costs, or, preferably, more economical costs than for known barrels.

The invention therefore concerns a timepiece barrel for pivotal assembly between a plate and a bar and including at least one spring housed between a pivoting drum and a cover and hooked between, at the outer end thereof, said drum, and at the inner end thereof, an arbor which pivots integrally with a ratchet about a pivot axis, said barrel including a one-piece sub-assembly coaxial to said pivot axis and containing said arbor and a boss provided with a collar for limiting the axial shake of said drum, wherein said collar carries pivotal drive means for driving the pivoting of said ratchet, which is axially free in the direction of said pivot axis, and wherein the shake of said drum is limited in lower abutment relative to said one-piece sub-assembly by an upper surface of said drum which is limited by a lower shoulder of said one-piece sub-assembly, wherein the shake of said ratchet is limited in lower abutment relative to said bar, by an upper surface of said ratchet which is limited by a thread or a lower surface of said bar or of a jewel comprised in said bar, wherein the shake of said ratchet is limited in upper abutment relative to said drum by a lower surface of said ratchet which is limited by an upper surface of said drum, and wherein the shake of said cover is limited in upper abutment relative to said plate, by a lower surface of said cover which is limited by an upper surface of said plate or of a jewel comprised in said plate, wherein said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, wherein said spring has a width to thickness ratio of between 3 and 23, and in that the ratio between the maximum radius of a bearing shoulder of the spring of said arbor and the thickness of said spring is between 3 and 9.

According to one characteristic of the invention, said one-piece sub-assembly is pivoted on an upper shoulder in a bore of said bar or of a jewel comprised in said bar, and includes an upper shoulder, whose travel is limited by a lower surface of said bar or of said jewel, said ratchet being comprised between said upper shoulder and a lower shoulder comprised in said one-piece sub-assembly on said boss, said lower shoulder limits the travel of an upper surface of said drum, said drum pivots in a bore comprised therein with a cylindrical shoulder of said boss.

According to one characteristic of the invention, said lower shoulder is formed by a lower abutment surface of said collar.

According to one characteristic of the invention in a first variant, said collar separates said drum from said ratchet, and includes an upper abutment surface for the abutment of a lower surface of said ratchet, and carries said pivotal drive means on the opposite side to that of said lower abutment surface and beyond said upper abutment surface.

According to yet another characteristic of the invention, said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shearing modulus of between 80 and 100 GPa, said spring has a width to thickness ratio of between 3 and 23, and the ratio between the maximum radius of a bearing shoulder of the spring of said arbor and the thickness of said spring is between 3 and 9.

The invention also concerns a timepiece movement including at least one plate and a bar and a barrel of this type.

The invention also concerns a watch including a movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
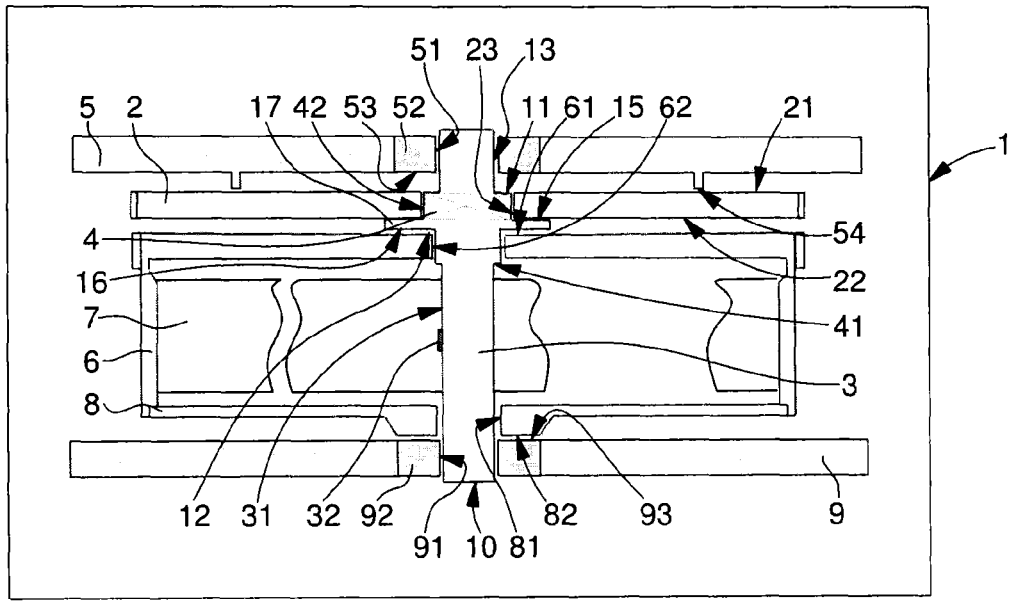
FIG. 1 shows a schematic cross-section of a barrel according to a first variant of the invention through the pivot axis thereof.

The invention concerns the field of timepiece mechanisms, and more specifically energy storage mechanisms, of the mainspring barrel, striking barrel or similar type.

The invention thus concerns a timepiece barrel 1 for pivotal assembly between a plate 9 and a bar 5 and including at least one spring 7. This spring 7 is housed between a pivoting drum 6 and a cover 8 and is hooked between drum 6, at the outer end thereof, and an arbor 3, at the inner end thereof. Arbor 3 is mounted to pivot integrally with a ratchet 2 about a pivot axis D.

According to the invention, barrel 1 includes a one-piece sub-assembly 10 coaxial to arbor 3 and containing arbor 3 and a boss 4 provided with a collar 17 for limiting the axial shake of drum 6. This collar 17 carries pivotal drive means 42, such as flat portions, squares or similar, for driving the pivoting of ratchet 2, on complementary drive means 23. This ratchet 2 is axially free in the direction of pivot axis D.

This one-piece sub-assembly 10 is pivoted on an upper shoulder 13 in a bore 51 of bar 5 or of a jewel 52 comprised in bar 5 and includes an upper shoulder 11, whose travel is limited by a lower surface 53 of bar 5 or of jewel 52. Ratchet 2 is comprised between upper shoulder 11 and a lower shoulder 12 comprised in one-piece sub-assembly 10 on boss 4. This lower shoulder 12 limits the travel of an upper surface 61 of drum 6. This drum 6 pivots in a bore 62 comprised therein with a cylindrical shoulder 41 of boss 4. In the first variant of FIG. 1, this lower shoulder 12 is formed by a lower abutment surface 16 of collar 17. In this same variant, collar 17 separates drum 6 from ratchet 2 and includes an upper abutment surface 15 for supporting a lower surface 22 of ratchet 2. This collar 17 carries pivotal drive means 42 on the opposite side to that of lower bearing surface 16 and beyond upper bearing surface 15, on the side of bar 5.

Arbor 3 includes a preferably cylindrical shoulder 31, which preferably has a smaller diameter than that of cylindrical shoulder 41 of boss 4. Arbor 3 carries spring 7, either on shoulder 31 thereof, on which spring 7 is secured by friction or welded, or on a hook 32 comprised in arbor 3 around such a shoulder 31. Arbor 3 is pivotally mounted in a bore 91 of plate 9 or of a jewel 92 comprised in plate 9. In a preferred embodiment, shoulder 31 is extended and forms the pivoting surface in said bore 91 or said jewel 92.

Drum 6 carries a cover 8 which preferably, but not necessarily, pivots integrally with drum 6, and whose bore 81 cooperates with a shoulder 31 of arbor 3. The travel of a lower surface 82 of cover 8 is limited by an upper surface 93 of plate 9 or of a jewel 92 housed in plate 9, with a bore 91 of plate 9 or of jewel 92 acting as pivot for shoulder 31 of arbor 3.

The shake of drum 6 is limited in upper abutment relative to ratchet 2, by an upper surface 61 of drum 6, which is limited by a lower shoulder 12 of one-piece sub-assembly 10.

The shake of drum 2 is limited in upper abutment relative to bar 5, by an upper surface 11 of one-piece sub-assembly 10, which is limited by a lower surface 53 of bar 5 or of a jewel 52 comprised in bar 5.

The shake of cover 8 is limited in upper abutment relative to plate 9 by a lower surface 82 of cover 8, which is limited by an upper surface 93 of plate 9 or of a jewel 91 comprised in plate 9.

The mainspring may be made of various materials: carbon steel, stainless steel, "Nivaflex®", silicon, DLC, quartz, glass or similar. In a particular application, spring 7 is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa. This spring 7 preferably has a width to thickness ratio of between 3 and 23, and more particularly between 9 and 21.

Also, the maximum radius of shoulder 31 of arbor 3 (not taking account of any excess thickness of a hook 32), made of steel or stainless steel, for example of 4C27A hardenable steel (also called according to the various standards 1.4197, ASTM 420F, or DIN X22 CrMoNiS 13 1), relative to pivot axis D is less than nine times the maximum thickness of spring 7. In particular, with the illustrated embodiments it is possible to obtain a ratio of the maximum radius of shoulder 31 of arbor 3 to the thickness of spring 7 of between 3 and 9, and preferably between 4 and 6, preferably close to five.

Figure 2:
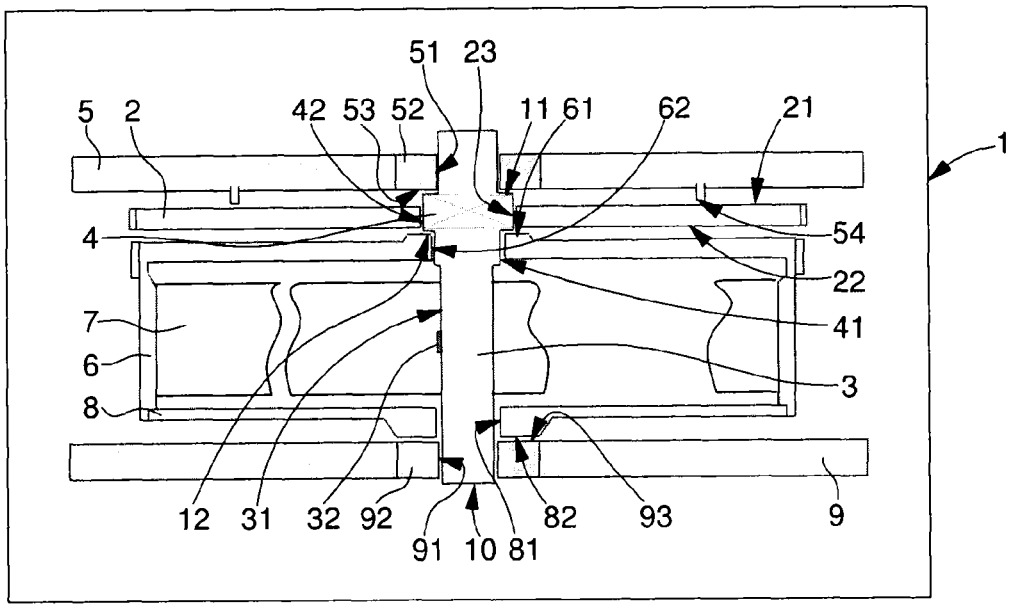
FIG. 2 shows a schematic cross-section of a barrel according to a second variant of the invention through the pivot axis thereof.
Figure 3:
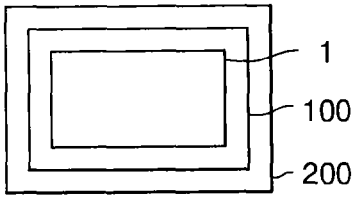
FIG. 3 shows a schematic block diagram of a timepiece including a movement which in turn includes a barrel according to the invention.

FIGS. 1 and 2 illustrate two preferred but non-limiting variants, which are each explained in detail below:

First variant of FIG. 1:

The shake of drum 6 is limited in upper abutment relative to one-piece sub-assembly 10, by an upper surface 61 of drum 6, which is limited by a lower surface 12 of one-piece sub-assembly 10.

The shake of ratchet 2 is limited in lower abutment relative to bar 5, by an upper surface 21 of drum 2, which is limited by a screw thread 54 or a lower surface 53 of bar 5 or of a jewel 52 comprised in bar 5.

The shake of ratchet 2 is limited in upper abutment relative to one-piece sub-assembly 10 by a lower surface 22 of ratchet 2 which is limited by an upper abutment surface 15 of a collar 17 of one-piece sub-assembly 10.

The shake of cover 8 is limited in upper abutment relative to plate 9 by a lower surface 82 of cover 8 which is limited by an upper surface 93 of plate 9 or of a jewel 91 comprised in plate 9.

Second variant of FIG. 2:

The shake of drum 6 is limited in lower abutment relative to one-piece sub-assembly 10, by an upper surface 61 of drum 6, which is limited by a lower surface 12 of one-piece sub-assembly 10.

The shake of ratchet 2 is limited in lower abutment relative to bar 5, by an upper surface 21 of drum 2, which is limited by a screw thread 54 or a lower surface 53 of bar 5 or of a jewel 52 comprised in bar 5.

The shake of ratchet 2 is limited in upper abutment relative to drum 6 by a lower surface 22 of ratchet 2 which is limited by an upper surface 61 of drum 6.

The shake of cover 8 is limited in upper abutment relative to plate 9 by a lower surface 82 of cover 8 which is limited by an upper surface 93 of plate 9 or of a jewel 91 comprised in the plate.

In short, the first variant of FIG. 1 is advantageous as the ratchet is axially free, and the collar on the arbor facilitates assembly. The advantage of this construction is that there is no limit to the core diameter.

The second variant of FIG. 2 also includes an axially free ratchet, there is a double limit on the drum. The core diameter is limited by the dimensions of drive means 42, typically a square or similar.

The invention also concerns a timepiece movement 100 including at least one plate 9 and a bar 5 and a barrel 1 of this type. Advantageously, bar 5 includes a least one screw thread 54 intended to cooperate in abutment, with the smallest possible contact surface, with upper surface 21 of ratchet 2.

The invention also concerns a watch 200 including a movement 100 of this type.

The invention claimed is:

1. A timepiece barrel for pivotal assembly between a plate and a bar, the timepiece barrel comprising:

at least one spring housed between a pivoting drum and a cover and hooked between, at an outer end thereof, said drum, and at an inner end thereof, an arbor which pivots integrally with a ratchet about a pivot axis, said barrel including a one-piece sub-assembly coaxial to said pivot axis and including said arbor and a boss including a collar to limit axial shake of said drum, wherein said collar carries a pivotal driver to drive pivoting of said ratchet, which is axially free in the direction of said pivot axis, wherein shake of said drum is limited relative to said one-piece sub-assembly by an upper surface of said drum which is limited by a lower shoulder of said one-piece sub-assembly, wherein shake of said ratchet is limited relative to said bar, by an upper surface of said ratchet which is limited by a thread or a lower surface of said bar or of a jewel comprised in said bar, wherein shake of said ratchet is limited relative to said drum by a lower surface of said ratchet which is limited by an upper surface of said drum, wherein shake of said cover is limited relative to said plate, by a lower surface of said cover which is limited by an upper surface of said plate or of a jewel comprised in said plate, wherein said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, wherein said spring has a width to thickness ratio of between 3 and 23, and the ratio between the maximum radius of a bearing shoulder of the spring of said arbor and the thickness of said spring is between 3 and 9.

2. A barrel according to claim 1, wherein said one-piece sub-assembly is pivoted on an upper shoulder in a bore of said bar or of a jewel comprised in said bar, and includes an upper shoulder, whose travel is limited by a lower surface of said bar or of said jewel, said ratchet being comprised between said upper shoulder and a lower shoulder comprised in said one-piece sub-assembly on said boss, said lower shoulder limits the travel of an upper surface of said drum, said drum pivots in a bore comprised therein with a cylindrical shoulder of said boss.

3. A barrel according to claim 2, wherein said lower shoulder is formed by a lower abutment surface of said collar.

4. A barrel according to claim 3, wherein said collar separates said drum from said ratchet, and includes an upper abutment surface for the abutment of a lower surface of said ratchet, and said collar carries said pivotal driver on the opposite side to that of said lower abutment surface and beyond said upper abutment surface.

5. A barrel according to claim 2, wherein said arbor includes a shoulder which has a smaller diameter than that of said cylindrical shoulder of said boss, and carries said spring, either on said shoulder onto which said spring is secured by friction or welded, or on a hook comprised in said arbor around said shoulder, and said shoulder pivots in a bore of said plate or of a jewel comprised in said plate.

6. A barrel according to claim 1, wherein said drum carries said cover pivoting integrally with said drum and a bore of said cover cooperates with a shoulder of said arbor, and travel of a lower surface of said cover is limited by an upper surface of said plate or of a jewel housed in said plate, a bore of said plate or of said jewel acting as pivot for said shoulder of said arbor.

7. A timepiece movement comprising at least one plate and a bar and a barrel according to claim 1.

8. A movement according to claim 7, wherein said bar includes at least one screw thread configured to cooperate in abutment, with a contact surface, with the upper surface of said ratchet.

9. A watch comprising a movement according to claim 7.

* * * * *